US008141645B2

(12) United States Patent
Poldervaart et al.

(10) Patent No.: US 8,141,645 B2
(45) Date of Patent: Mar. 27, 2012

(54) OFFSHORE GAS RECOVERY

(75) Inventors: Leendert Poldervaart, Monte Carlo (MC); Jim Wodehouse, Houston, TX (US)

(73) Assignee: Single Buoy Moorings, Inc., Marly (CH)

( * ) Notice: Subject to any disclaimer, the term of this patent is extended or adjusted under 35 U.S.C. 154(b) by 207 days.

(21) Appl. No.: 12/655,671

(22) Filed: Jan. 5, 2010

(65) Prior Publication Data

US 2010/0175884 A1 Jul. 15, 2010

Related U.S. Application Data

(60) Provisional application No. 61/144,999, filed on Jan. 15, 2009.

(51) Int. Cl.
*E21B 17/01* (2006.01)
*E21B 43/01* (2006.01)

(52) U.S. Cl. ..... 166/367; 166/344; 166/352; 166/369; 166/75.12; 405/224.2; 414/137.9

(58) Field of Classification Search ..... 166/367, 166/339, 344, 351–355, 267, 369, 75.12; 405/210, 224.2–224.4; 414/137.1, 137.9, 414/142.8; 114/256, 257, 264; 137/899.2, 137/899.4

See application file for complete search history.

(56) References Cited

U.S. PATENT DOCUMENTS

| | | | | |
|---|---|---|---|---|
| 4,375,835 | A * | 3/1983 | Archer | 166/339 |
| 5,025,860 | A * | 6/1991 | Mandrin | 166/267 |
| 5,477,924 | A * | 12/1995 | Pollack | 166/357 |
| 5,549,164 | A * | 8/1996 | Blandford | 166/344 |
| 6,230,809 | B1 * | 5/2001 | Korsgaard | 166/352 |
| 6,250,244 | B1 * | 6/2001 | Dubar et al. | 114/264 |
| 6,345,672 | B1 * | 2/2002 | Dietzen | 175/66 |
| 6,517,290 | B1 * | 2/2003 | Poldervaart | 405/224.2 |
| 6,698,989 | B2 * | 3/2004 | Snowdon | 414/137.1 |
| 6,702,539 | B2 * | 3/2004 | Snowdon | 414/137.1 |
| 6,709,216 | B2 * | 3/2004 | Snowdon | 414/137.1 |
| 6,709,217 | B1 * | 3/2004 | Snowdon | 414/137.1 |
| 6,745,856 | B2 * | 6/2004 | Simpson et al. | 175/66 |
| 6,796,379 | B1 * | 9/2004 | Martin | 166/356 |
| 6,973,948 | B2 * | 12/2005 | Pollack et al. | 141/387 |
| 7,017,506 | B2 * | 3/2006 | van Wijngaarden et al. T | 114/74 |
| 7,033,124 | B2 * | 4/2006 | Snowdon | 414/137.1 |
| 7,066,219 | B2 * | 6/2006 | Poldervaart et al. | 141/387 |
| 7,119,460 | B2 * | 10/2006 | Poldervaart et al. | 307/149 |
| 7,174,930 | B2 * | 2/2007 | Poldervaart et al. | 141/387 |
| 7,186,062 | B2 * | 3/2007 | Snowdon | 406/121 |

(Continued)

FOREIGN PATENT DOCUMENTS

WO WO 2009/124372 A2 10/2009

*Primary Examiner* — Thomas Beach
*Assistant Examiner* — Matthew Buck
(74) *Attorney, Agent, or Firm* — Leon D. Rosen

(57) ABSTRACT

During an Extended Well Test or Early Floating Production at an offshore hydrocarbon production site, where oil and gas hydrocarbons are produced by a production vessel, applicant stores the natural gas as pressured gas in a storage tank and occasionally transfers the pressured gas to a shuttle vessel which carries the gas to a site where it is used, as by pumping it into a natural gas pipeline. The transfer of natural gas to the shuttle can be accomplished by pumping it through a conduit extending between the vessels to a second tank on the shuttle, or can be accomplished by moving a gas-filled tank on the production vessel to the shuttle.

5 Claims, 3 Drawing Sheets

U.S. PATENT DOCUMENTS

| | | | | |
|---|---|---|---|---|
| 7,506,702 | B1 * | 3/2009 | Patterson et al. | 175/66 |
| 7,544,018 | B2 * | 6/2009 | Snowdon | 406/146 |
| 7,628,224 | B2 * | 12/2009 | D'Souza et al. | 175/5 |
| 7,673,577 | B2 * | 3/2010 | Poldervaart et al. | 114/230.1 |
| 7,975,769 | B2 * | 7/2011 | Pollack et al. | 166/350 |
| 2002/0134455 | A1 * | 9/2002 | Emblem et al. | 141/1 |
| 2003/0051875 | A1 * | 3/2003 | Wilson | 166/268 |
| 2004/0238176 | A1 * | 12/2004 | Appleford et al. | 166/353 |
| 2006/0283590 | A1 * | 12/2006 | Poldervaart et al. | 166/265 |

* cited by examiner

OFFSHORE GAS RECOVERY

CROSS-REFERENCE

Applicant claims priority from U.S. Provisional patent application No. 61/144,999 filed 15 Jan. 2009.

BACKGROUND OF THE INVENTION

When an offshore hydrocarbon reservoir appears to have potential, an initial or early production system of limited cost may be set up which produces moderate amounts of gas and oil. The initial production system can be useful to see whether the reservoir has the potential to produce large amounts of hydrocarbons and therefore justify an expensive production facility. The initial production facility also may be useful to produce substantial revenue during the period of time when a larger facility is being designed and installed. Until about 15 years ago, only oil was considered valuable, and steps were taken to get rid of the gas. One approach was to flare the gas (burn it). Another approach was to compress the gas and inject it into a disposal well. A third approach was to compress the gas and export it via a subsea pipeline, but that disposal approach was available only if there was a customer close enough to make it economical to build the seafloor pipeline. More recently, the advantage of natural gas in producing less local pollution and in producing less carbon dioxide than oil or coal has been realized, and it is now common to export natural gas by long distances by cooling it (below −161° C.) so the gas becomes liquefied. The gas is carried a long distance by tanker in the form of LNG (liquefied natural gas). Applicant notes that as LNG, natural gas takes up a space that is 600 times smaller than the space that would be occupied by the same amount of natural gas at atmospheric pressure. However, facilities for cooling natural gas to produce LNG, storing and handling the LNG and then reheating the LNG, are usually not available during early testing and production. A low cost system and method for utilizing the limited amounts of natural gas that are available during early testing and production, which may last several months to a few years, would be of value.

SUMMARY OF THE INVENTION

In accordance with one embodiment of the invention, a method and system are provided for the economical utilization of gaseous hydrocarbons that are produced during testing and early production at an offshore hydrocarbon reservoir. In a system where production of hydrocarbons is made through a production vessel that is connected through a riser to a well head at the sea floor, considerable amounts of produced gas is stored under pressure in at least one gas tank on the production vessel. The system also includes a shuttle vessel, or shuttle, which repeatedly sails to the location of the production vessel where it receives the stored pressured (compressed) gas, and sails away to a site where the compressed natural gas can be profitably sold, as where it is pumped into a distribution pipeline or into a storage tank to power equipment.

In one method, the pressured gas in a first tank on the production vessel can be passed through a conduit (e.g. a hose or loading arm) to a second tank on the shuttle. In another method, the first tank, which holds pressured gas, is transferred by a hoist to the shuttle. A third tank, which is empty and which was carried by the shuttle, is transferred to the production vessel to take the place that was occupied by the first tank that was transferred from the production vessel to the shuttle.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
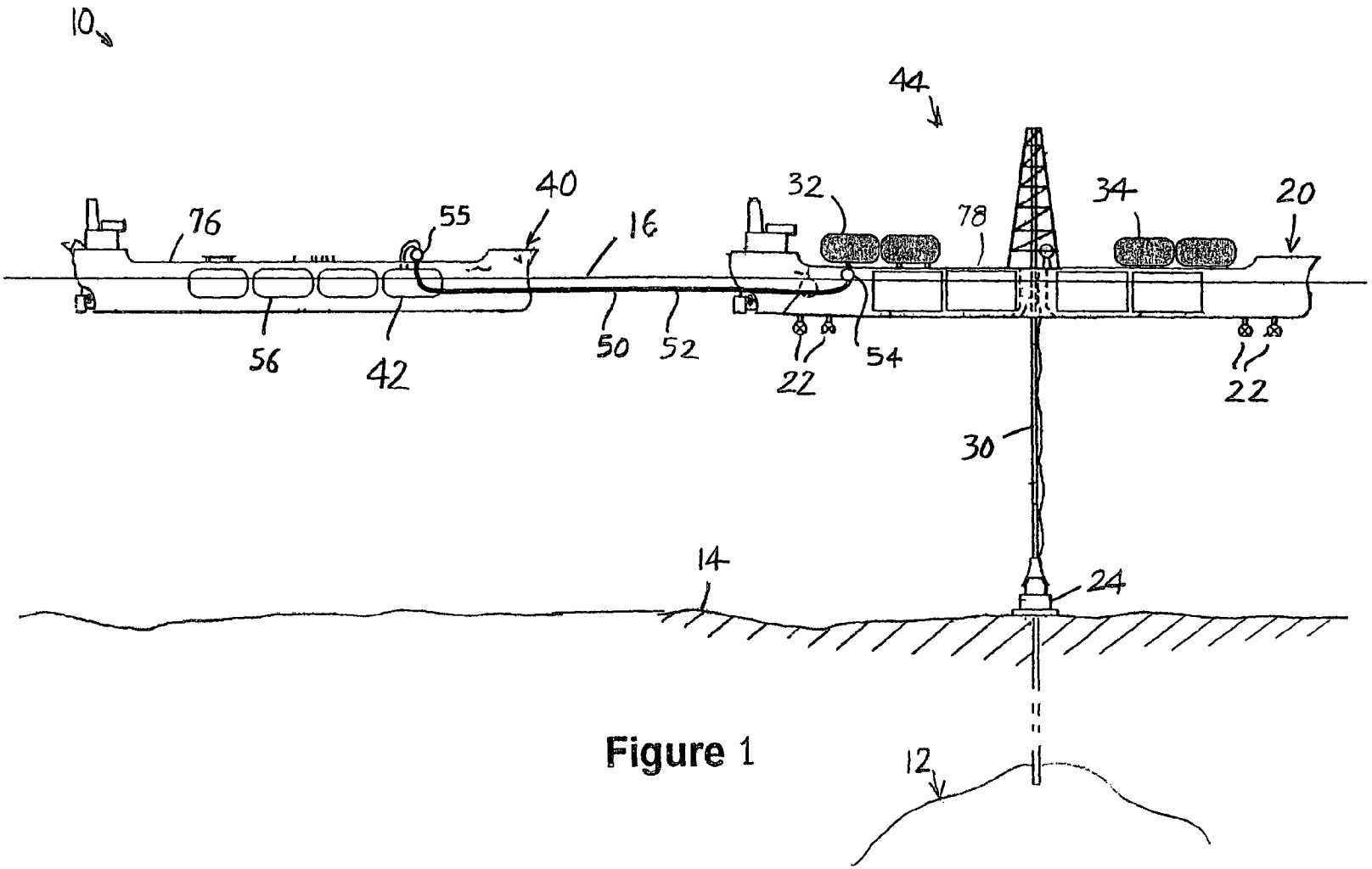
FIG. 1 is a side elevation view of a system for early production of hydrocarbons from an offshore reservoir, showing pressured gas being transferred through a conduit from a tank on the production vessel to a tank on a shuttle.

FIG. 1 shows a system 10 for the early production of hydrocarbons from an offshore hydrocarbon reservoir 12 which is a reservoir under a sea floor 14 of a sea 16. The system includes a production vessel 20 which preferably is a DP (dynamically positioned vessel) that has thrusters 22 for maintaining it at a position in the vicinity of a location over a well head 24 that extends into the reservoir. A riser 30 extends from the well head up to the production vessel and carries well effluent comprising hydrocarbons, to the vessel. The vessel carries equipment for removing sand, rocks, water and other unwanted materials that accompanies hydrocarbons produced from the reservoir. The early production of hydrocarbons may be part of a test for evaluating the reservoir, so as to determine whether a costly production system such as a fixed platform with a LNG (liquefied natural gas) production facility should be installed, or a less costly production system such as one with a floating production body that is moored by catenary chains should be installed, or some other system should be installed. The early production system also may be used to produce revenue while another system is being designed or installed in the vicinity.

The system 10 of FIG. 1, as with most hydrocarbon production systems, produces both oil (hydrocarbon that is liquid at a common environmental temperature such as 60° F., or 15° C.) and gas (hydrocarbon that is gaseous at that temperature). The gas is stored under pressure in a gas tank(s) 32 while oil is stored in the same or a different tank(s) 34. For a given amount of energy (e.g. in btu's) that can be produced, oil is more valuable than gas because oil can be more easily transported and stored. In the system 10, gas is used to provide power for running the production vessel, as to fuel engines that drive the thrusters 22 that position the DP vessel and to run an engine-generator set that produces electricity. Although oil is generally more valuable than gas, gas has become more valuable than in the past, in part because it is "clean burning" (produces less soot than coal or oil) and produces less carbon dioxide whose production may soon be regulated.

Applicant provides a shuttle vessel, or shuttle 40, which repeatedly comes to the vicinity (within 0.5 kilometer) of the production vessel 20, receives pressured gas (gas at a pressure of a plurality of bars, or at least 30 psi) which is unloaded from tank(s) 32 on the production vessel. The shuttle stores the pressured gas in a tank(s) 42 on the shuttle, and carries the pressured gas to a distant location (a plurality of kilometers away) where the pressured gas is unloaded. As mentioned above, if gas is stored as LNG then 600 times as much gas can be stored in a given volume as gas at atmospheric pressure (15 psi). If gaseous gas is stored at a high pressure such as 1000 psi, then about ten times as much gas can be stored as LNG in a given volume than can be stored as high pressure gaseous gas. However, as mentioned above the use of LNG involves a large investment at the production site (as well as the receiving or consuming site or facility).

The transport of pressured gas from the early production site 44 where the well head 24 is located, has an important advantage, that pressured gas can be unloaded by the shuttle to a consuming facility at low cost because the pressured gas does not have to be heated as does LNG. Also, the shuttle carries far less gas than does an LNG tanker, so many more potential customer exist who can receive and use limited amounts of gas, including customers closer to the production site than exist for LNG. The shuttle 40 carries on the order of magnitude of 10,000 standard cubic meters of gas (gas at atmospheric pressure), as compared to an LNG tanker which carries more than ten or one hundred times as much and which generally delivers its load only to a large facility such as a special port near a major city that can quickly unload, store, reheat, and sell to customers the huge amount of LNG unloaded from the tanker. Applicant notes that 10,000 standard cubic meters at 240 bar is about 10 to 20 days of gas production by the production vessel, so offloading is done about every 10 to 20 days (i.e. 5 to 40 days).

FIG. 1 shows pressured gas stored in a first tank 32 on the production vessel, and a conduit 50 that includes a hose 52 that extends from the first tank 32 to the second tank 42 which lies on the shuttle. At first, the pressure of gas in the first tank flows it to the second tank, but then a pump 54 is used to pump additional gas into the second tank. The pump can lie at 55 on the shuttle so the hose 52 does not have to withstand a very high pressure. When the second tank is filled (when the second tank holds gas at the desired pressure), the shuttle sails away to a distant facility where it unloads gas from the second tank. When the second tank is empty, the shuttle sails back to the production site and again receives pressured gas from the first tank that lies on the production vessel. Oil in a tank such as 34 on the production vessel is also offloaded to a tank 56 on the shuttle and later unloaded at a receiving facility.

In the figures, a tank filled with hydrocarbons (gas or oil) is indicated by the presence of shading, while an empty tank is indicated by the absence of shading. In FIG. 1 the tanks 42, 56 on the shuttle are stored beneath the deck 76 of the shuttle because there is little equipment required that would take up the space beneath the deck. The tanks 32, 34 on the production vessel 20 are usually stored on the deck 78 of the vessel because space under the deck in usually taken by equipment used in production, such as processing equipment that removes sand, gas and water from the produced hydrocarbons.

Figure 2:
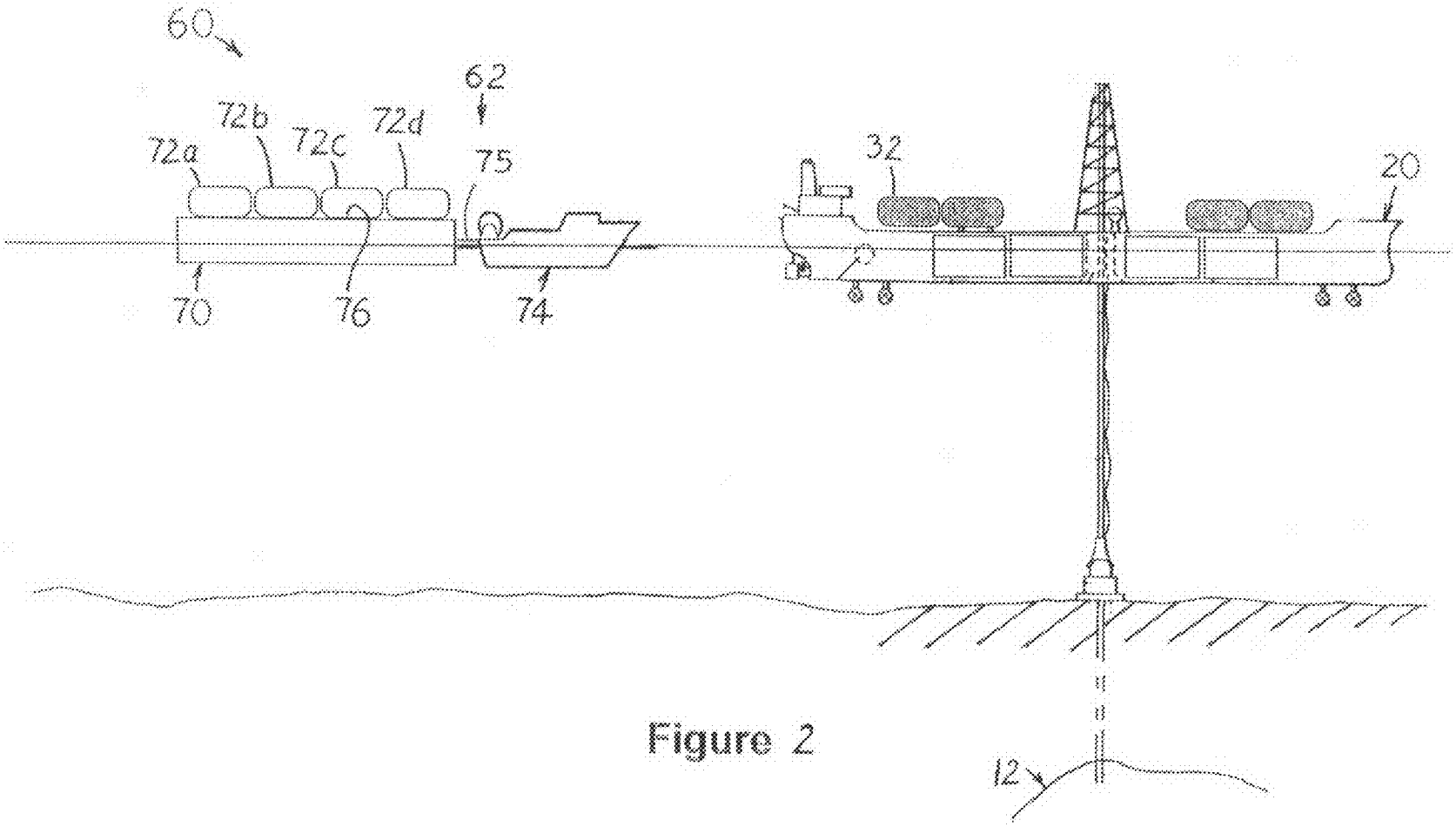
FIG. 2 is a side elevation view of a system similar to that of FIG. 1, showing a shuttle approaching the production vessel and carrying empty tank(s) intended to be exchanged for pressured gas-containing tanks on the production vessel.
Figure 4:
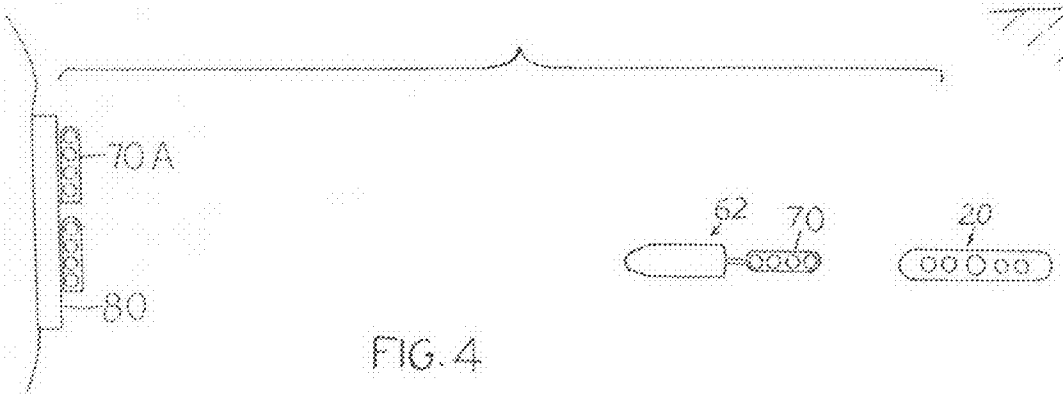
FIG. 4 is a plan view of the system of FIG. 3, and including two barges at a location distant from the production vessel and reservoir.

FIG. 2 shows another system 60 for the early production of hydrocarbons from an offshore reservoir, wherein pressured hydrocarbon gas is transferred from the production vessel 20 to a shuttle 62 by the physical transfer of a tank 32 on the production vessel, to the shuttle. In FIG. 2, the shuttle includes a barge 70 that carries tanks 72*a*, 72*b*, 72*c* and 72*d*, and also includes a tug boat 74 that pulls the barge and that is connected to the barge by a disconnectable coupling 75. An advantage of using a barge and a separate tugboat, is that a barge 70A (FIG. 4) can be left parked at an unloading facility 80 while gas is slowly unloaded from the tank(s) or is being stored in the tanks until a later time when the gas can be used. The barge 70A and the tanks on the barge are of only modest cost. During storage of gas in tanks on the barge, the tugboat 74 is being used to move another barge 70.

Figure 3:
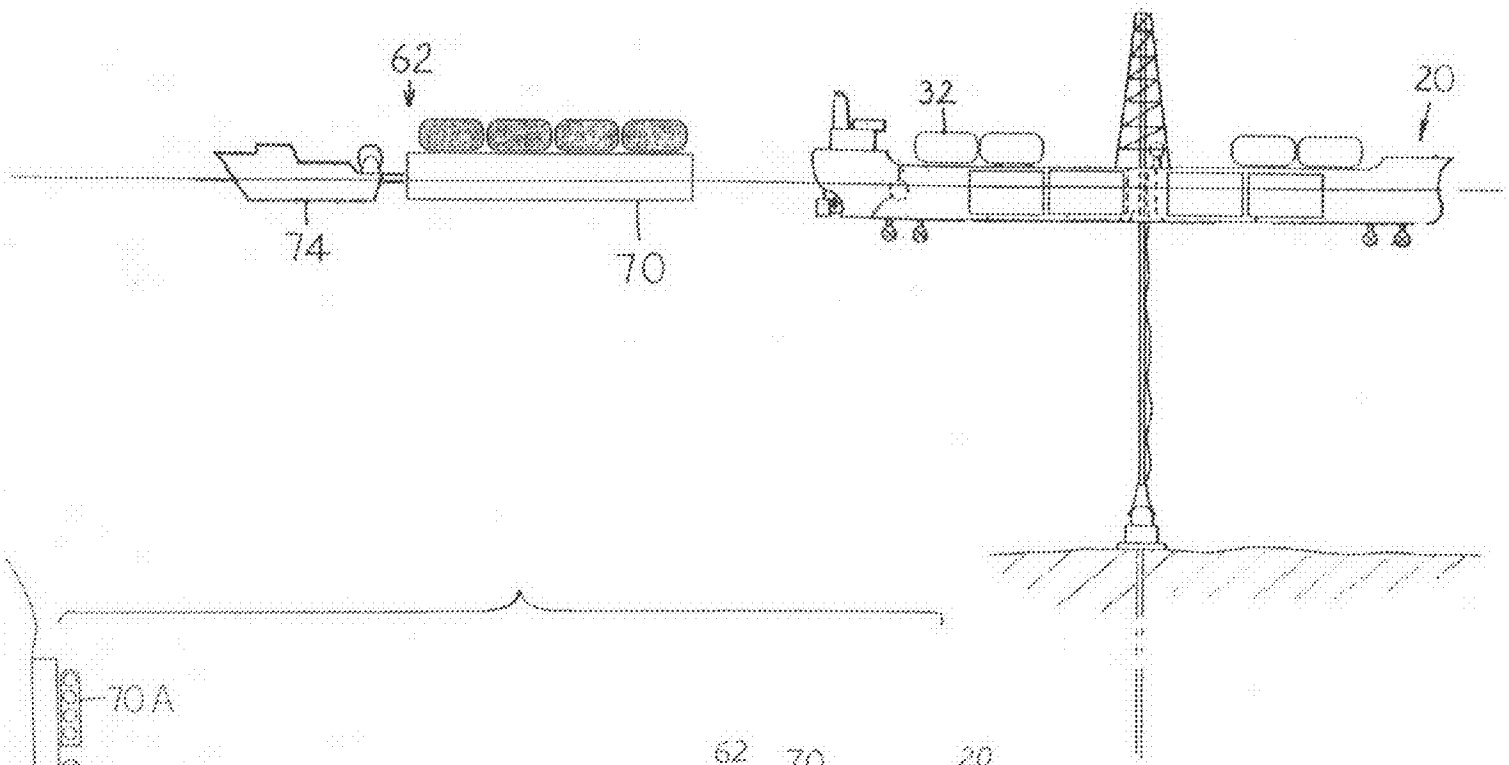
FIG. 3 is a side elevation view of the system of FIG. 2, showing the shuttle carrying gas-filled tanks and sailing away from the vicinity of the production vessel and reservoir.

In FIG. 2, the tug boat brings the barge 70 alongside the production vessel 20 and fixes it to the production vessel. A hoist is used to physically move one or more tanks between the production vessel and the barge. The tank is moved to a space on the barge that will have been left empty so it can receive the tank. A modest cost hoist can be used because it is repeatedly used only to move tanks of a predetermined size. The weight of hydrocarbons in each gas-holding tank and each oil holding tank can be more equalized by storing oil in a lower part of each tank and gas in the upper part of the tank. As a result, the hoist does not have to move a tank that is very heavy because it is completely filled with oil, but moves primarily or only tanks filled with both oil and gas. FIG. 3 shows the barge sailing away from the production vessel, with tanks on the barge filled with hydrocarbons and with tanks on the production vessel being empty.

In FIGS. 2 and 3, the tanks 72 on the barge of the shuttle, are stored on the deck 76 of the barge. This is done to facilitate the transfer of the tanks from one vessel to another one or to a final offloading facility. In FIG. 1 tanks 42, 56 are stored beneath the shuttle deck 76 because the tanks are not moved and because the volume below the shuttle deck is largely empty.

In one example, each tank such as 32 has a length and width of six meters each, and a height of three meters, for a volume of 108 meters$^3$. The tank holds methane at a pressure of 16 Bars (1000 psi). The production vessel and shuttle each transport two tanks filled with gas (and two filled with oil) having a mass of 500 tons, by a distance of 50 kilometers to a customer. An LNG terminal to be built later at that site uses a tanker to carry 50,000 tons of LNG in each trip.

Thus, the invention provides systems for the early production of hydrocarbons from an offshore reservoir, which effectively produces and distributes gaseous hydrocarbons and usually also oil. Produced gas is stored in tanks on the production vessel as pressured gas. The pressured gas is offloaded to a shuttle, which transports it to a distant facility where the pressured gas is offloaded (as is oil). One way to offload the gas is to pass it through a hose or the conduit of a loading arm, to a tank on the shuttle. The pressure of gas stored in the tank on the production vessel is used to move some of the gas to the tank on the shuttle, and a separate pump is used to move the rest. Another way to offload the gas is to move one or more entire tanks that each contains pressured gas, from the deck of the production vessel to the deck of the shuttle. The shuttle can include a barge on which gas tank(s) are stored and a separate tug boat for moving the barge, or for leaving the barge stationary with the tanks thereon being used for storage.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A system for the early production of hydrocarbons from an undersea reservoir that produces at least gas, which includes a production vessel and a riser that extends from a sea floor base that extends into the reservoir up to the production vessel, comprising:

a gas storage first tank on said production vessel that is capable of storing pressured gaseous hydrocarbons produced from said reservoir;

a shuttle and a second tank on said shuttle:

a conduit connected to transfer pressured as from said first gas storage tank on said production vessel to said second tank on said shuttle, said shuttle being movable so it can carry pressured gas to a distant location and unload pressured gas thereat and return to the vicinity of said production vessel;

a pump on said shuttle for pressurizing gas in said second tank without requiring said conduit to carry gas at the same pressure as exists in said second tank.

2. A system for the early production of hydrocarbons from an undersea reservoir that produces at least gas, which includes a production vessel and a riser that extends from a sea floor base that extends into the reservoir up to the production vessel, comprising:

a gas storage first tank on said production vessel that is capable of storing pressured gaseous hydrocarbons produced from said reservoir;

a shuttle;

means for transferring pressured gas from said first tank to said shuttle, said shuttle being movable so it can carry pressured gas to a distant location and unload pressured gas thereat and return to the vicinity of said production vessel;

said means for transferring includes a hoist that moves said gas storage first tank from a position on said production vessel to a position on said shuttle.

3. A method for utilizing produced hydrocarbons which includes gas, produced from an undersea reservoir by a production vessel that is connected to a riser that extends from a sea floor base that connects to the reservoir and up to the vessel, comprising:

storing produced gas under pressure in a first tank on said production vessel;

sailing a shuttle vessel to the vicinity of said production vessel, transferring said produced gas that is stored under pressure in said first tank, to said shuttle vessel, sailing said shuttle vessel out of the vicinity of said production vessel while carrying said produced gas as gas under pressure, unloading the gas from said shuttle vessel, and returning said shuttle vessel to said vicinity of said production vessel to receive pressured gas, while continuing to produce hydrocarbons from said reservoir;

said step of transferring includes transferring said first tank with pressured gas inside it, from said production vessel to said shuttle vessel.

4. The method described in claim 3 wherein:

said shuttle vessel comprises a tugboat and a barge, and including at least one additional barge, each barge being capable of holding at least one tank that is capable of storing pressured gas; and including parking one of said barges that holds a tank with pressured gas therein at a stationary location, while using said tugboat to move another of said barges that holds a tank.

5. The method described in claim 3 including:

using said shuttle vessel to carry a substantially empty third tank to the vicinity of said production vessel, transferring said empty third tank to said production vessel and storing produced gas under pressure in said empty third tank.

* * * * *